United States Patent [19]

Dahowski et al.

[11] Patent Number: 4,980,934

[45] Date of Patent: Jan. 1, 1991

[54] RETROFITTABLE RECEPTOR DEVICE

[75] Inventors: Donald E. Dahowski, York; Stephen F. Gray, Sr., Lancaster, both of Pa.

[73] Assignee: Quaker Plastic Corporation, Mountville, Pa.

[21] Appl. No.: 367,998

[22] Filed: Jun. 19, 1989

Related U.S. Application Data

[63] Continuation-in-part of Ser. No. 270,150, Nov. 14, 1988, abandoned.

[51] Int. Cl.[5] ..... E04H 4/14

[52] U.S. Cl. ..... 4/496; 4/506; 52/222; 52/249

[58] Field of Search ..... 4/488, 496, 506, 503; 52/63, 222, 249

[56] References Cited

U.S. PATENT DOCUMENTS

| | | | |
|---|---|---|---|
| 3,186,712 | 6/1965 | Kessler | 52/222 X |
| 3,628,198 | 12/1971 | Katzman | 4/506 X |
| 3,667,071 | 6/1972 | Hoch et al. | 4/506 X |
| 3,777,318 | 12/1973 | Stillman | 4/506 X |
| 3,938,199 | 2/1976 | Laren | 4/506 X |
| 4,064,571 | 12/1977 | Phipps | 4/506 X |
| 4,067,155 | 1/1978 | Ruff et al. | 4/503 X |
| 4,158,244 | 6/1979 | Stefan | 4/506 X |
| 4,233,790 | 11/1980 | Meadows | 52/222 |
| 4,335,474 | 6/1982 | Bailey | 4/506 |
| 4,429,425 | 2/1984 | Weir et al. | 4/503 |
| 4,601,073 | 7/1986 | Methot | 4/506 |
| 4,706,308 | 11/1987 | Palmere | 4/503 X |
| 4,713,849 | 12/1987 | Kindness | 4/506 X |

FOREIGN PATENT DOCUMENTS

| | | | |
|---|---|---|---|
| 1214421 | 12/1970 | United Kingdom | 52/222 |

*Primary Examiner*—Charles E. Phillips

*Attorney, Agent, or Firm*—Arthur J. Plantamura

[57] ABSTRACT

A longitudinal receptor construction for insertion into a channel or opening and for holding a desired element is provided. The receptor has an inverted L-shape cross section in which a horizontal leg is advantageously suited for retrofit usage in an existing groove or channel opening and has locking features which afford substantially improved capability for holding the receptor and the element inserted into the receptor.

The groove into which the receptor is positioned may be the groove contiguous to a swimming pool coping and may be the same groove devised for and used to hold another element such as the peripheral bead of a swimming pool liner. Sufficient gripping force by the horizontal receptor leg in the locking groove or channel is provided by the receptor leg configuration which prevents dislodging of the receptor leg by forces pulling on the receptor or other member which may be present in the opening.

Advantageously the receptor may be used on an existing pool coping which has a channel or groove into which the peripheral bead of a vinyl liner which covers the swimming pool bottom is positioned. The securing leg of the receptor of the invention is of slender construction and contoured that it can be accommodated, together with the bead of the swimming pool liner, within a conventional pre-existing channel or groove such as that in the upper inner wall or coping of a swimming pool which houses the bead of a pool liner.

10 Claims, 2 Drawing Sheets

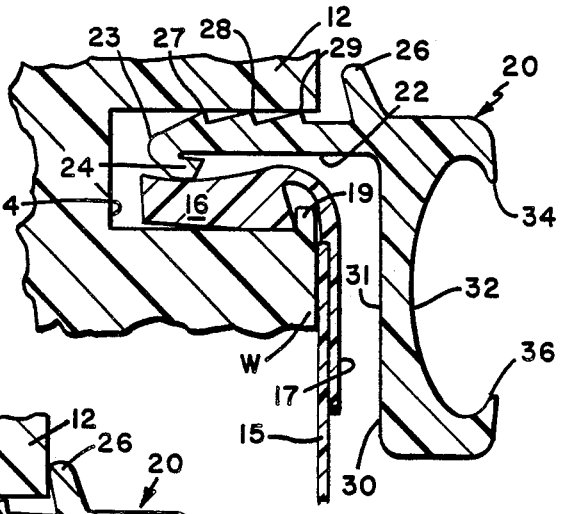
FIG. 4
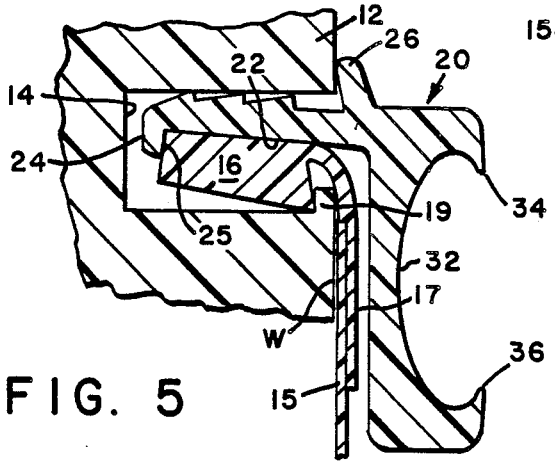
FIG. 5
FIG. 2A
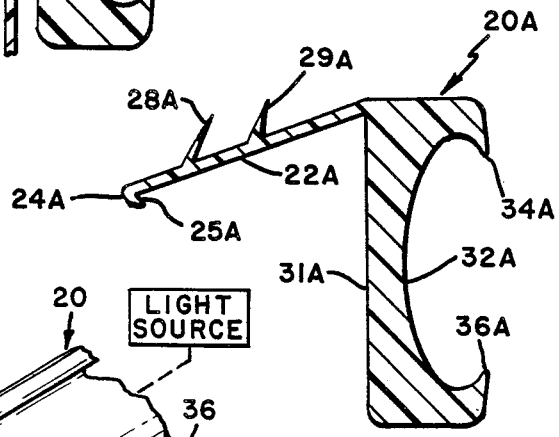
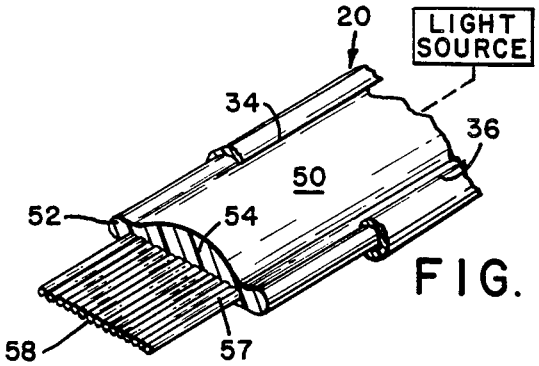
FIG. 6

RETROFITTABLE RECEPTOR DEVICE

This application is a continuation-in-part of application Ser. No. 07/270,150 filed Nov. 14, 1988 now abandoned.

The invention relates to an attachable device that is insertable in a slot or groove and is used for securing a desired element in place within the device. More particularly, the invention relates to a device of this kind which may be used as a retrofit means in conjunction with an existing arrangement that includes a channel or groove which is employed for some other purpose in the pre-existing arrangement. For example, in the case of a swimming pool, a peripheral channel or groove is present contiguous to the top of the inner wall; the groove being required for holding the bead of a pliable plastic swimming pool liner. The invention thus comprises a device that is attachable in such, or other, channel or groove and used to hold a desired element such as a sign, a border or finish tile, a fiber optic light, decorative trim, and the like.

BACKGROUND OF THE INVENTION

The prior art contains various structures which are designed to use grooves, channels, slots, or other openings therein, to hold an element for which the opening was provided. One such structure, for example, is the peripheral slot contiguous to the top at the inside of a swimming pool wall in which the peripheral bead, at the top of the flexible plastic swimming pool liner, is inserted to suspend the liner in position. While provision may be made in the design of such structures for securing additional desired accessories or elements, such "special" provision would add substantially to the cost and, in a standard design, when the additional accessory is not desired or not used, such additional grooves, channels, or other openings, present an unsightly appearance. Moreover, in many pre-existing arrangements, it would be desirable if an accessory receptor device could be conveniently and economically retrofitted onto an existing structure.

Also, in the past, when additional accessories are found to be desirable, a separate holding means for the additional accessory has been provided. This is the situation, for example, with reference to the arrangement presented in U.S. Pat. No. 4,457,119 where an additional (a second) channel or groove is provided in the coping member; the lower cannel being used to hold the peripheral bead of the swimming pool liner and the upper channel being used to hold another member, such as a cover.

Accordingly, a need exists for a novel receptor device, which is unique in structure and performance and also has the advantage of being retrofittable, that permits an accessory to be attached therein and be secured within the receptor device.

SUMMARY OF THE INVENTION

An object of the invention resides in providing a novel receptor device or element that functions as a mounting base and which additionally can be secured in a pre-existing groove or channel and which receives for retention therein a variety of desired elements.

The receptor device of the invention, which is secured in a groove or channel, and which may be a pre-existing groove or channel, comprises an elongated member which, in cross section, has a generally inverted "L" shape; the first or horizontal leg of which functions to secure the receptor device in position, and the second or other leg, the vertical leg, of which functions to to receive for retention therein, a desired element, e.g. a decorative piece, tile member, fiber optic light element, and the like.

The horizontal or securing leg of the receptor device of the invention, which is formed of semi-rigid rubber or synthetic plastic composition, is contoured so as to permit insertion into a groove or channel and is provided with gripping means and a locking shoulder or lip, at the extremity of the leg, which flexes to afford a streamlined shape when inserted and which serves to lock the receptor in place on the bead which is already inplace in the groovewhen the receptor is fully seated in place in the receiving groove. The vertical leg is provided with a suitable means to receive the element which it is desired to secure in place within the receptor. To secure the desired element in place, the vertical leg of the receptor preferably comprises a concave quasi-eliptic opening, i.e., the end portions of the concave shape reverse direction to form a partial elipse and function to receive and to securely and detachably hold an element positioned therein without the need for supplemental fastening means, such as screws, adhesive, etc.

BRIEF DESCRIPTION OF THE DRAWING

The invention will be more fully understood from the following detailed description in conjunction with the several illustrative figures of the accompanying drawing in which:

FIG. 2A is a view similar to that of FIG. 2 showing an alternative form of receptor device according to the invention.

FIG. 4 is a fragmentary cross-sectional view similar to FIG. 3 showing the horizontal retaining leg of the receptor device of the invention, partially inserted, in conjunction with the swimming pool liner bead, within the channel or groove such as is formed in swimming pool coping near the top of a swimming pool wall.

FIG. 5 is a fragmentary cross-sectional view similar to that of FIG. 4 wherein the receptor device of the invention is shown in its fully in-place and "locked" position.

FIG. 6 is a perspective fragmentary view illustrating a fiber optics element secured in the concave opening in the vertical leg of the receptor device of the invention.

DETAILED DESCRIPTION OF THE INVENTION

Figure 1:
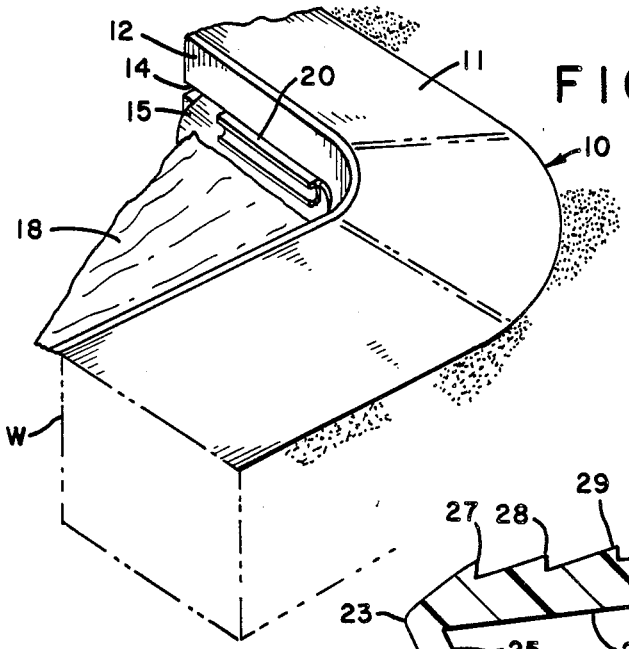
FIG. 1 is a perspective view, partly in section, of a fragmentary portion of a swimming pool that illustrates the location of the receptor device of the present invention in place, in a channel near the top of the inner wall, together with the bead of a swimming pool liner bead.

Reference is made to FIG. 1 of the drawing which illustrates a fragment 10 of a swimming pool with coping 12 partially embedded in a poured concrete deck 11 which surrounds the top of the vertical pool wall W. The lower portion of the coping 12 is formed with a horizontally extending channel 14 which functions to retain the bead of a liner 15 which is inserted into the holding channel 14.

The receptor device 20 of the invention shown in cross section in FIG. 2 will be discussed in greater detail by reference thereto in conjunction with FIGS. 3–5.

Figure 2:
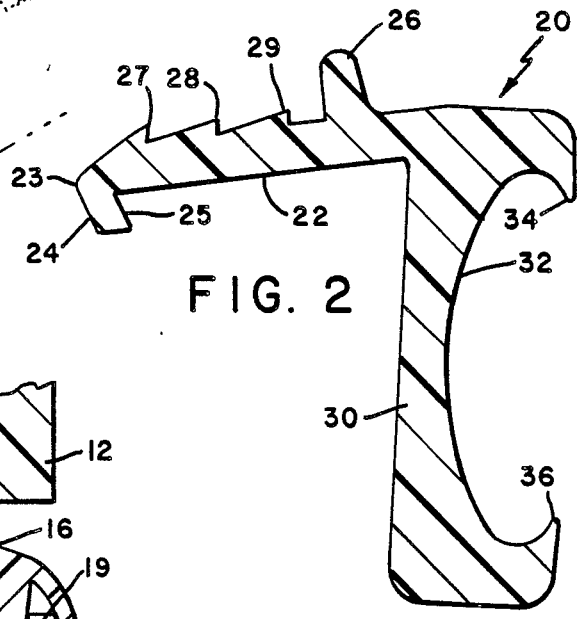
FIG. 2 is an enlarged view of the longitudinal receptor device of the invention illustrating in detail the preferred cross sectional configuration.

As shown in FIG. 2, the receptor device 20 comprises a longitudinal element which may be characterized as generally having an inverted L-shaped cross section. The receptor device 20 has a horizontal leg 22 used to hold the receptor in place and a vertical leg 30, which includes a concave opening 32 and devised to retain therein the desired element. The horizontal leg 22 comprises an end portion 23 with a depending portion or lip 24 and a locking shoulder 25 and is formed so that depending portion 24 flexes and insertion into a relatively restricted opening is facilitated. In other words, the composition of the reception while substantially rigid is also sufficiently pliable or flexible so that upon compression the depending lip 24 is flexed upward back against the leg 22 under compression to give a streamlined shape (as shown in FIG. 4) during insertion into a restricted opening, to more readily permit entry of leg 22 into a holding channel or groove of the kind shown as 14 (FIG. 3). The groove or channel 14 is preferably provided with a lip 19 at the mouth of the lower surface of the opening 14 to aid in retention of an element, such as the peripheral bead of a swimming pool liner, inserted therein. Grooves of this kind in which extensions or lips are formed at the bottom or top surfaces at the mouth of the opening are illustrated in U.S. Pat. No. 4,429,425. It is contemplated that groove 14 may be occupied or crowded already by an element such as the bead 16 (FIG. 3) leaving at best only limited space. As shown in FIG. 4, the flexing back or "stream-lining" of the lip 24 on the horizontal leg of the receptor 20 results in a shape simulating an arrowhead at the top 23 of leg 22 thereby minimizing resistance to the sliding insertion of the leg 22 of the receptor 20 into the holding groove or opening 14. The horizontal leg 22 may also be provided optionally with one or more saw tooth-like backward canted gripping protuberances 27, 28 and 29, which are formed such as to not impede the insertion of the leg 22 into a narrow restricted slot or groove while at the same time supplementing the gripping force on the leg 22 and aiding in the locking of the receptor 20. In the embodiment of FIG. 2, when the leg 22 is fully inserted and the face of the vertical leg 30 abutsthe swimming pool wall, or the liner and/or bead 15 and 17, respectively, which is draped over the vertical wall of the swimming pool. As shown in FIGS. 2, 4 and 5, an optional supplemental abutting means may be included, such as stop member 26 which abuts against the vertical surface of coping 12. The stop member 26 abuts the wall 12 contiguous to the opening 14. Additionally, when the vertical leg 22 is substantially fully inserted, lip 24 at the extremity of the leg 22 is extended, and shoulder 25 is in abutment with the top of the bead 18, as illustrated in FIG. 5. Referring again to FIG. 2, the vertical leg 30 at its outer face is provided with a concave or quasi-eliptic shaped opening which receives and holds an element therein. While the means used to hold an element in the opening 32 comprises an arrangement as shown in which the element (such as 50) may be removably snapped into and held in place in the recess 32 for easy removabe when desired, such holding means may optionally also include a fastener or adhesive. In the holding means shown, the concave quasi-eliptic shaped opening 32 is contoured so as to partially wrap back and possesses element retaining tips 34 and 36 at opposite ends of the concave opening 32. The desired element, to be inserted and retained in the concave opening 32 and secured in position by the tips 34 and 36, may comprise a variety of items as such for example, tiles, signs, decorative strips or inserts, a fiber-optic light strip, and the like. The item secured in the concave recess 32 of the receptor of the invention is held inplace without additional holding means.

As shown in FIG. 6, a fiber-optics light arrangement 50 of the kind illustrated in U.S. Pat. No. 4,763,984, may be inserted, such as by snapping in place, into the receptor and held secure by tips 34 and 36 of the receptor structure. Such fiber-optic units generally comprise, for example, a lens region 54, translucent fiber elements 58, and may include a reflectant surface 57 with light being transmitted through the fiber by a suitable light source.

Figure 3:
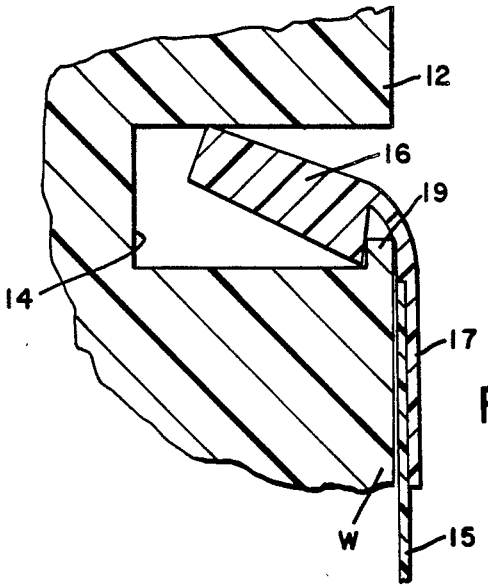
FIG. 3 is a fragmentary cross-sectional view of a typical channel or groove which is formed to receive and to retain therein an element such as the peripheral bead, as shown, of a swimming pool liner.

In the use of the receptor 20 of the invention as shown in FIG. 2, reference is made in particular to FIG. 3–5 of the drawing and with reference to a channel or groove formed in the coping or wall of a swimming pool. It will be apparent, however, that the invention is not to be construed as limited for use only with swimming pools or with channels for retaining swimming linear beads. Rather, it will be apparent that the receptor of the invention can be used in any of a variety of grooves or channels whether such are specifically devised to receive the receptor of the invention or whether such opening, i.e. such groove or channel, pre-exists to be used for other purpose and the receptor of the invention is then retrofitted into such pre-existing opening.

Because of the slender configuration of horizontal leg 22 of the receptor 20 of the invention and the appropriate resiliency of the cooperating parts, the insertion of the leg 22 into the channel 14, even though the channel 14 may already house the liner bead 16, is readily effected. Once in place, the protuberances 27, 28 and 29 at the top and the shoulder 25 of lip 24 at the bottom abutting against the top of liner bead 16 retain the receptor 20 securely in the locked/holding position.

In the embodiment illustrated in FIG. 2A, a relatively more slender horizontal securing leg 22A is illustrated for use with a "more crowded" groove, i.e., where relatively restricted space remains in the groove, in which to insert the horizontal leg of the receptor device. In the embodiment of FIG. 2A, the reference numerals followed by the letter "A" correspond to parts and their function similar to those of like reference numerals in the structure shown in FIG. 2.

The horizontal leg 22A of FIG. 2A differs from the receptor device of FIG. 2 primarily in that the optional upward extending protrusion 26 shown in FIG. 2 is omitted, and the upward extending holding fingers, two of which 28A and 29A are shown, are relatively more slender and are formed at a greater angle with the horizontal than are the protuberance or extensions 27, 28 and 29 of FIG. 2. In some applications, the omission of the upward protrusion or stop member similar to that shown as 26 in FIG. 2 is unnecessry, may be aesthetically undesirable, and does not add to the essential performance, since the holding power of extensions 28A and 29A in conjunction with the abutment of face 31A against the wall W and abutting lip 25A suffice to provide a secure hold.

The receptors 20 and are preferably formed of any well known semi-rigid plastic, i.e. synthetic resin composition, such as nylon, polyvinyl chloride, polyester, polycarbonate, polyolefin e.g. polypropylene or polyethylene, and the like, which, while of sufficient rigidity and toughness, possesses the desired resiliency and is comprised of a cross section adequate to withstand substantial stress and deformation while being inserted into the channel without damage. The receptor is sized so that the leg 22 (or 22A) is sufficiently slender and can be inserted into a channel or groove opening even when the groove is occupied. The extensions or ridges or protrusions extending upward from the horizontal leg are angled backward to facilitate insertion and, because they are angled backward, have the tendency to resist withdrawal once they have been inserted into position. This snug fit including the frictional grip of the protrusions 28A and 29A and the depending lip 24A, maintain the receptor in place. Should removal of the receptor element 22 or (22A) be desired, a prying tool (not shown) is inserted to disengage the shoulder 25 (or 25A from its depending abutting position.

While a single protrusion or extension positioned intermediately along the top of the horizontal surface of the leg 22 (or 2A) may suffice to aid in preventing the leg from sliding back, any practical number of additional serrations or extensions, two of which are shown, 27 and 29, may formed on the upper surface of leg 22 of the receptor 20. Thus the additional or supplemental ridges or extensions 27 and 29 afford sufficient additional pressure against the upper face of the groove or channel 14 and against the liner bead 16 which is pressed down against the lower face of the groove 14 thereby preventing dislodgment of the bead 18 or of the leg 22 from channel 14. Similarly this applies to the extensions 28A and 29A of the receptor 20A shown in FIG. 2A.

While the preferred embodiments of the invention have been disclosed in detail, it is to be understood that various alternative details or equivalents which fall within the scope of the invention as claimed may be made by those skilled in the art without departing from the invention.

What is claimed is:

1. A receptor device for attachment in a groove of a swimming pool wall, said groove containing a bead of a swimming pool accessory, said receptor device being formed of a substantially rigid but yieldable composition and devised with a recess to retain an element therein, and comprising:

(a) a longitudinal structure having, in cross-section, a shape that has generally an inverted L-shape configuration and having a horizontal leg and a vertical leg;

(b) said horizontal leg of the receptor device having a depending lip at the extremity of said leg and which lip flexes to provide a streamlined form as the leg is inserted into a restricted space in said groove between said bead and a surface of said groove and which lip is extended beyond said bead to a position where the horizontal leg will be in contact with a surface of said bead and said lip will flex into a locking position adjacent another bead surface opposing said surface of said bead and locks said horizontal leg in place when the horizontal leg is substantially fully inserted into said groove; and (c) said vertical leg being integrally formed with said horizontal leg, said vertical leg abuts on one side against the said surface of said body when the said receptor is in functional position and said vertical leg contains a securing means on the other side in which the desired element is positioned and retained.

2. The receptor device of claim 1 which is further provided with an upper stop member which abuts against said body when the said horizontal leg is substantially fully inserted within the groove in said body.

3. The receptor of claim 2 which is further provided on the upper side of said horizontal leg at least one protuberance intermediately located between said stop member and said depending lip.

4. The receptor of claim 1 in which the securing means in the vertical leg comprises a concave recess having a quasi-eliptic shaped opening in which the opening is narrower than the recess.

5. The receptor of claim 1 wherein a fiber optic light element is contained within said recess formed in said vertical leg.

6. In combination a swimming pool provided with:

(I) a peripheral groove contiguous to the top of the inner wall of the pool and housing, in said groove, the bead of a swimming pool vinyl liner, and (II) a receptor device for attachment contiguous to said peripheral groove to hold an element therin, said receptor comprising:

(a) a longitudinal structure having, in cross section, a shape having a generally inverted L-shape configuration; that comprises a horizontal leg and vertical leg;

(b) said horizontal leg of said receptor having a depending lip at the extremity of said horizontal leg and which lip flexes to provide a streamlined form as the leg is inserted into a restricted space in said groove between said bead and a surface of said groove and which lip is extended beyond said bead to a position where the horizontal leg will be in contact with a surface of said bead and said lip will flex into a locking position adjacent another bead surface opposing said surface of said bead and locks said horizontal leg in place when the horizontal leg is substantially fully inserted into said groove; and (c) said vertical leg being integrally formed with said horizontal leg and wherein said vertical leg abuts on one side against said surface of said body when the said receptor is in functional position and said vertical leg contains a recess on the other side into which the desired element is positioned and retained.

7. The combination of claim 6 wherein the receptor device is provided with an upper stop member which abuts against the said body when the horizontal leg is substantially fully inserted in the groove in said body.

8. The combination of claim 7 wherein the receptor is provided on the upper side of said horizontal leg with at least one protuberance intermediately located between said stop member and said depending lip.

9. The combination of claim 6 wherein the securing means in the vertical leg comprises a concave recess having a quasi-eliptic shaped opening in which the opening is narrower than the recess.

10. The combination claim 6 wherein a fiber optic light element is contained within the recess formed in the vertical leg of the receptor.

* * * * *